US005311726A

United States Patent [19]

Rauscher et al.

[11] Patent Number: 5,311,726

[45] Date of Patent: May 17, 1994

[54] AIR EXTRACTION APPARATUS FOR CONTINUOUS PACKAGE MAKING

[76] Inventors: Franc W. Rauscher, 19 Oakridge West, St. Peters, Mo. 63376; Daniel P. McEntee, 225 Bellm, Florissant, Mo. 63031

[21] Appl. No.: 899,732

[22] Filed: Jun. 17, 1992

[51] Int. Cl.[5] ..... B65B 9/06; B65B 31/04

[52] U.S. Cl. ..... 53/511; 53/550

[58] Field of Search ..... 53/88, 90, 110, 374.4, 53/433, 511, 512, 550

[56] References Cited

U.S. PATENT DOCUMENTS

| | | | |
|---|---|---|---|
| 2,410,834 | 11/1946 | Messmer | 53/512 X |
| 2,763,107 | 9/1956 | Day et al. | 53/90 |
| 3,274,746 | 9/1966 | James et al. . | |
| 3,553,933 | 1/1971 | Seko | 53/550 |
| 3,619,975 | 11/1971 | Johnson et al. | 53/512 |
| 3,701,229 | 10/1972 | Zelnick | 53/511 X |
| 3,745,742 | 7/1973 | Tartarini . | |
| 4,170,863 | 10/1979 | Schwanz . | |
| 4,272,944 | 6/1981 | Suga . | |
| 4,663,915 | 5/1987 | Van Erden et al. . | |
| 5,052,166 | 10/1991 | Ziegler et al. . | |

FOREIGN PATENT DOCUMENTS

| | | | |
|---|---|---|---|
| 8003993 | 2/1982 | Netherlands | 53/511 |
| 2124995 | 2/1984 | United Kingdom . | |

*Primary Examiner*—John Sipos
*Assistant Examiner*—Linda B. Johnson
*Attorney, Agent, or Firm*—Rogers, Howell & Haferkamp

[57] ABSTRACT

The present invention relates to an improved air extraction apparatus for continuous package making. More particularly, the present invention relates to an improved air extraction apparatus that continuously packages a continuous succession of objects in a continuous length of heat-sealable packaging film. The apparatus extracts air from the packaging film that has been folded in a manner so that margins along opposite longitudinal edges of the film form a seam with two overlapping flaps for heat sealing, wherein just ahead of a heat sealing station, the improved apparatus of the invention extracts air from between the film flaps.

17 Claims, 3 Drawing Sheets

FIG. 3.
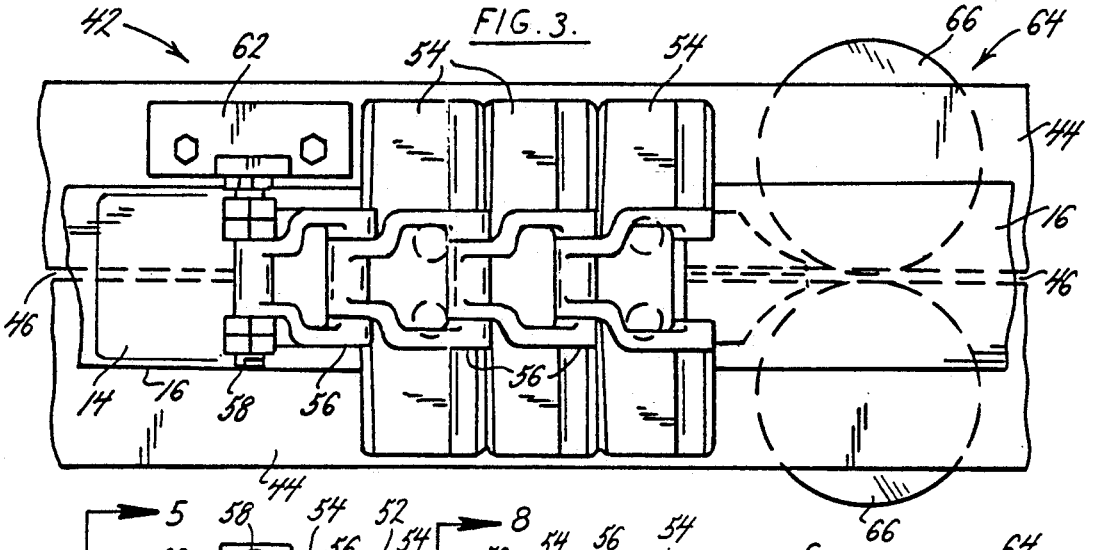
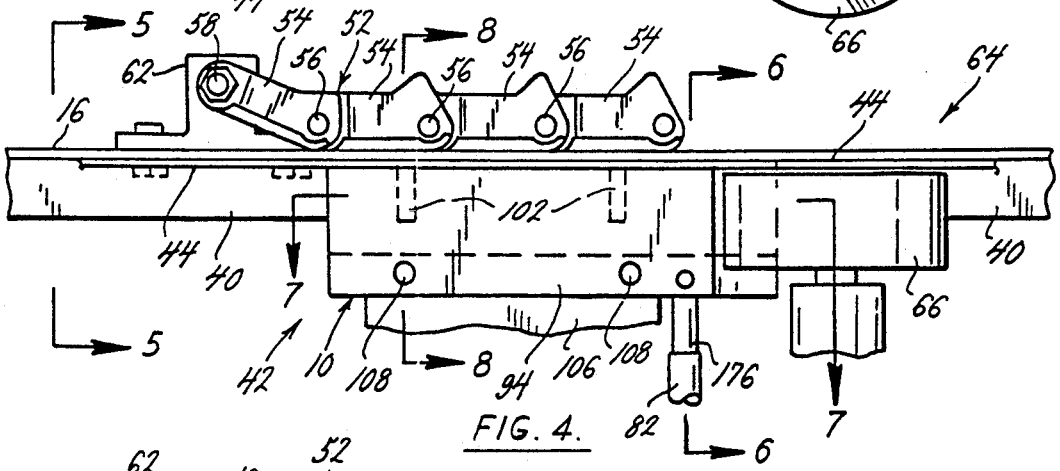
FIG. 4.
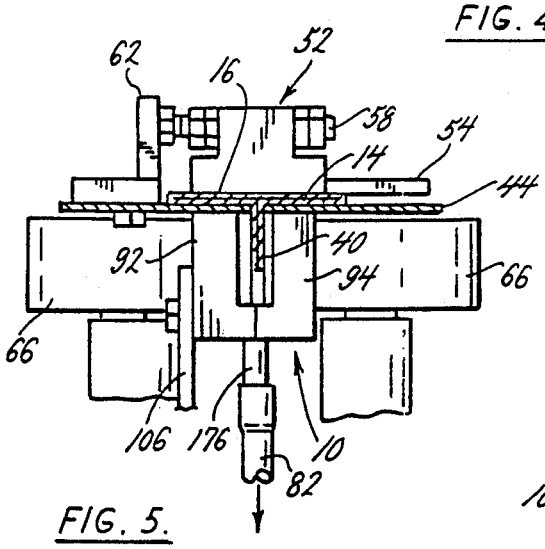
FIG. 5.
FIG. 6.
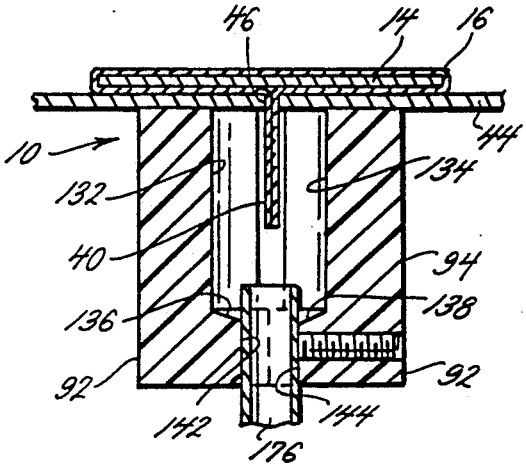

AIR EXTRACTION APPARATUS FOR CONTINUOUS PACKAGE MAKING

BACKGROUND OF THE INVENTION (1) Field of the Invention

The present invention relates to an improved air extraction apparatus for continuous package making. More particularly, the present invention relates to an improved air extraction apparatus that continuously packages a continuous succession of objects in a continuous length of heat-sealable packaging film. The apparatus extracts air from the packaging film that has been folded in a manner so that margins along opposite longitudinal edges of the film form a seam with two overlapping flaps for heat sealing, wherein just ahead of a heat sealing station, the improved apparatus of the invention extracts air from between the film flaps.

(2) Description of the Related Art

Air suction systems employed with apparatus that continuously package a continuous succession of objects in heat-sealable packaging film are known in the art. Prior art continuous packaging apparatus are typically comprised of several stations that progressively package a series of objects as the objects and a continuous supply of packaging film are conveyed past the stations. The typical apparatus comprise a supply station supplying packaging film in a continuous length to a folding station. At the folding station, the continuous length of packaging film is folded around a continuous succession of objects conveyed past the station. The manner of folding the film produces a continuous, longitudinal tube (usually not cylindrical) of packaging film with the objects enclosed therein. The manner of folding the film also produces a continuous seam along the tube where the opposite lateral edges or margins of the packaging film meet. The seam is formed by overlapping flaps of the film that extend along the longitudinal length of the film tube. After exiting the folding station, the tube and its two overlapping flaps are conveyed to a heat-sealing station that comprises a pair of driven rollers with opposed surfaces for gripping the flaps therebetween. The surfaces of the rollers are heated and seal the overlapping flaps of heat-sealable film together as the overlapping flaps pass between the rollers.

Prior to sealing the packaging film, it is desirable to extract as much air as possible from the interior volume of the packaging, thereby reducing the size of the packaged objects and reducing their shipping costs. For these typical continuous package making apparatus, the present invention is an improvement over the air suction systems of the prior art.

One type of prior art air suction system involves a suction nozzle. In use, the suction nozzle is stationed just ahead of the heat-sealing station. The suction nozzle draws air from the interior of the packaging tube by being positioned between the overlapping flaps of the packaging material as they are conveyed past the nozzle. This mode of operation requires that the nozzle separate the two flaps as they are conveyed past and slide across the opposite sides of the nozzle, with the flaps being rejoined after they have passed the nozzle and air has been extracted from the packaging. Prior art systems of this type are shown by U.S. Pat. Nos. 4,170,863 and 4,663,915.

Another type of prior art air suction system involves a vacuum chamber. The vacuum chamber is defined within a hollow housing positioned underneath or behind a conveyor surface on which the continuous tube of packaging film, with the objects enclosed therein, continuously slides across. The conveyor surface and chamber housing are provided with longitudinal slots that receive a packaging tube's two overlapping flaps as the packaging material is conveyed past the housing of the vacuum chamber. The vacuum chamber communicates with a vacuum pump that creates a vacuum pressure in the chamber housing and draws air from the packaging from between the two flaps during their passage through the chamber housing. Prior art systems of this type are shown by U.S. Pat. No. 5,052,166 and U.K. Patent No. 2,124,995.

Still another type of prior art air suction system involves an eductor pipe connected to a source of vacuum pressure. The eductor pipe is inserted between the two lapped edges of the packaging film at a location still ahead of the heat-sealing station. The eductor pipe extends longitudinally within the confines of the two lapped edges to an open pipe end positioned at a point past the heat-sealing station. Therefore, the eductor pipe extends right through the heat-sealing station, and the heat-sealing station is modified accordingly. Thus this type of an air suction system works on a different principle from the others in that air is siphoned out of the tube of packaging material at a location along the tube that is past the heat-sealing station rather than ahead of it. A prior art system of this type is shown by U.S. Pat. No. 4,272,944.

There are several disadvantages associated with the prior art systems. The type involving a nozzle is often unable to provide a desirable degree of vacuum. This results from numerous leaks which permit the reentry of air into the tube. The leaks are difficult to avoid because the overlapping flaps of packaging material must be separated in order for them to slide over the opposite sides of the nozzle. There are open voids between the flaps both before and after they pass around the nozzle and, in consequence, air persistently leaks between the passing flaps and stationary nozzle. This system is also disadvantaged in that the flaps will often be displaced from their positions extending around the nozzle as the packaging material is conveyed past the nozzle, requiring the system to be closed down until the flaps are repositioned.

The type of prior art air suction system involving the vacuum chamber is likewise unable to provide a desirable degree of vacuum. The leaks are present here because of the configuration of the longitudinal slot, and particularly because of the configuration of the entry and exit ends of the slot. The slot ends are open to permit the sliding entry and exiting of the continuously passing flaps of packaging material. The slots are often configured to be wide enough to avoid the imposition of any frictional engagement drag on the flaps being conveyed through the slot. Yet this also means that there are gaps between the flaps and the slot side walls that permit air from outside the packaging to leak into the slot. The result is a low operating efficiency and a less than desirable degree of vacuum.

The type of prior art air suction system involving an eductor pipe is chiefly deficient in requiring a modified, non-typical apparatus for continuous package making. These types of prior art air extraction systems have specialized constructions that are not readily retrofit to existing packaging conveying systems.

SUMMARY OF THE INVENTION

The improved air extraction apparatus of the present invention overcomes the disadvantages of the prior art by providing a vacuum block formed with a longitudinal slot and provided with a pair of slot-filling vacuum seals within the slot. In use, the two overlapping flaps of packaging material continuously pass through the slot and are engaged and closed against each other by the two seals. During their passage between the two seals, the flaps are subjected to a vacuum pressure that draws air from the interior of the packaging through the overlapping seals. One advantage of the present invention is that it does not require a suction nozzle to be inserted between the flaps. Another advantage of the present invention involves its capability of being retrofit to an existing continuous package-making apparatus, without the need for modifications or the like to the apparatus. Still other advantages involve the slot-filling suction seals in how they provide for the efficient extraction of air from the packaging material. The enhanced ability of the apparatus of the invention enables it to more efficiently draw air from the interior of packaging material, thereby reducing the overall size of the packaged objects. Reducing the size of the packaged objects enables more of them to be packed in cartons for shipping and thereby reduces shipping costs.

BRIEF DESCRIPTION OF THE DRAWINGS

Further objects and features of the present invention are revealed in the following detailed description of the preferred embodiment of the invention and in the drawing figures wherein:

FIG. 3 is a partial plan view taken along the line 3—3 of FIG. 1;

FIG. 4 is a partial side elevation view of the apparatus of the invention;

FIG. 5 is a rear elevation view, in section, taken along the line 5—5 of FIG. 4;

FIG. 6 is an elevation view, in section, taken along the line 6—6 of FIG. 4;

DESCRIPTION OF THE PREFERRED EMBODIMENT

Figure 2:
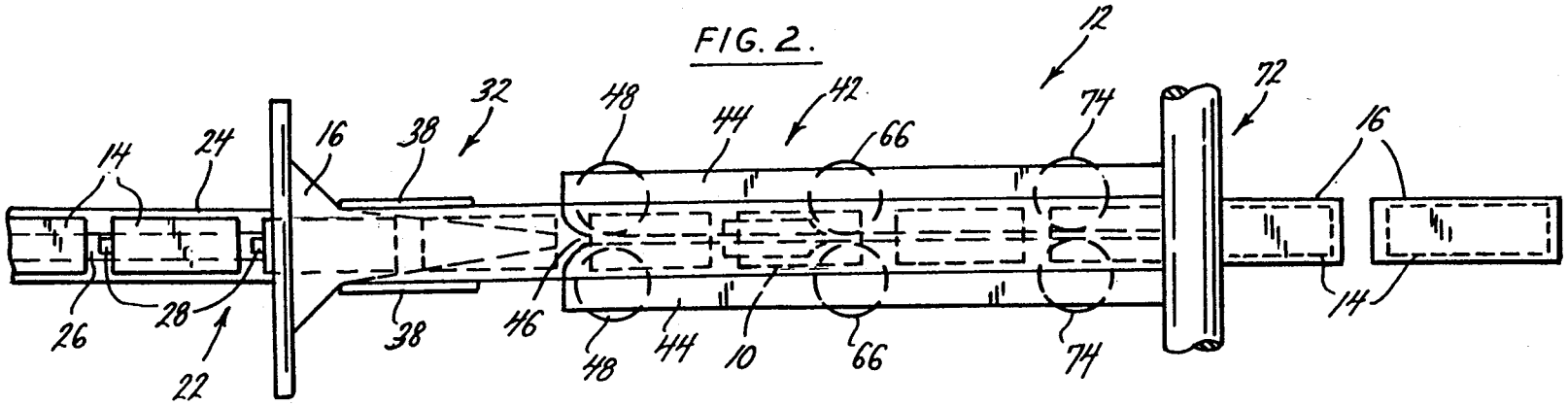
FIG. 2 is a plan view taken along the line 2—2 of FIG. 1.
Figure 1:
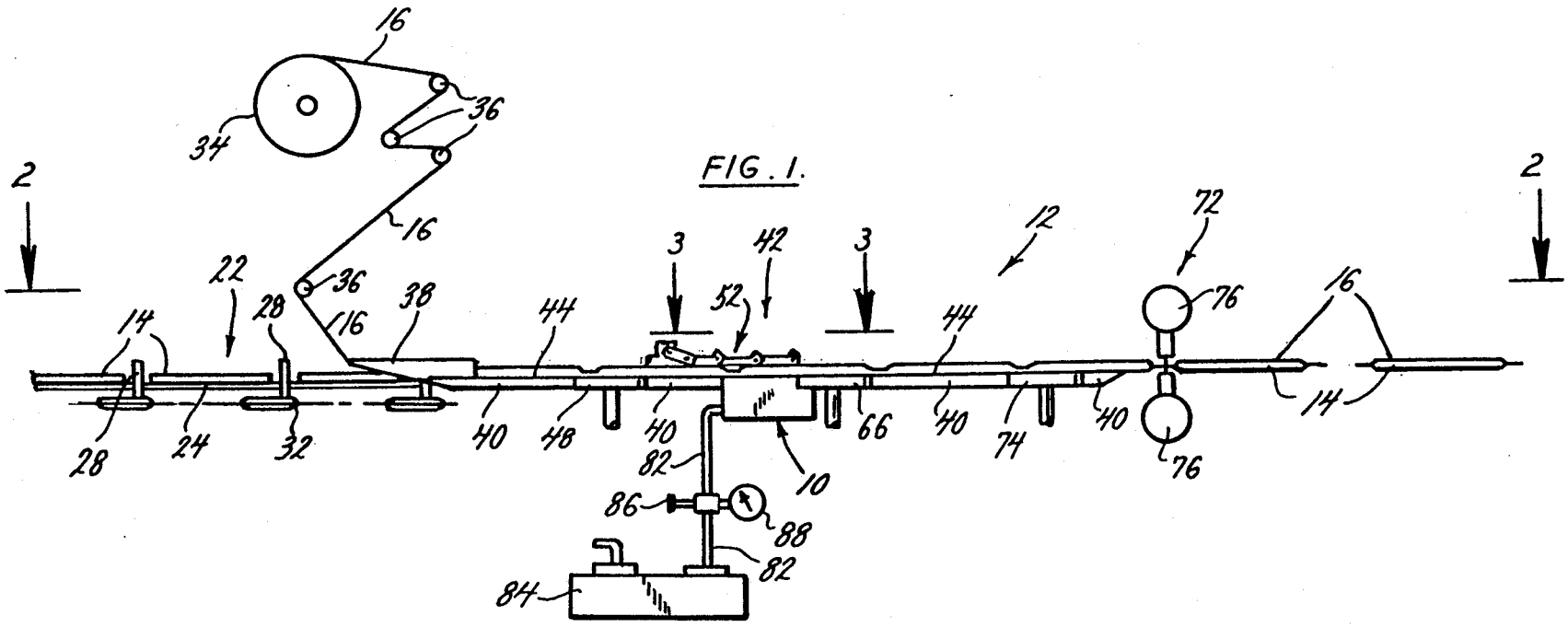
FIG. 1 is a side elevation view of the improved air extraction apparatus of the present invention shown employed with a typical continuous package conveyor system.

FIG. 1 shows one operative environment of the improved air extraction apparatus 10 of the present invention. Shown in FIGS. 1 and 2 is a conventional continuous packaging and sealing system for wrapping objects conveyed by the system in packaging material and then sealing the packaging material around the wrapped objects. The packaging system 12 shown somewhat schematically in the drawing figures is conventional except for the addition of the apparatus of the invention 10, and therefore will not be described in great detail. Although a particular packaging system 12 is shown in the drawing figures, it should be understood that the description of the apparatus of the invention 10 employed with this packaging system 12 is for illustrative purposes only and is not intended to be limiting. The air extraction apparatus 10 of the present invention is specifically designed to be easily retrofit to a variety of different packaging systems other than that shown in the drawing figures.

The conventional packaging system 12 shown in the drawing figures conveys a continuous series or succession of objects 14 through a number of stations of the system and sequentially wraps each of the individual objects 14 in a continuous sheet of flexible, plastic packaging material or film 16, extracts air remaining in the packaging material after it is wrapped over the objects, seals the packaging material around the wrapped objects, and then cuts each of the individually wrapped and sealed objects apart from the continuous sheet of packaging material sealed around the objects. In the operative environment shown in the drawing figures, the objects 14 are coupons or other types of advertising promotions that are wrapped and sealed in the packaging material 16 prior to their being packed in boxes containing products such as dry cereal, laundry detergent, and other similar types of goods. It should be understood that the packaging apparatus may be employed in wrapping and sealing within packaging material a variety of different types of objects other than the coupons 14 shown, and the description of the air extraction apparatus 10 of the present invention in withdrawing air from the packaging wrapped around the coupons 14 is illustrative only and should not be interpreted as limiting the invention to this one particular application.

Referring now to FIGS. 1 and 2 of the drawing figures, the conventional packaging system 12 includes an in-feed conveying system 22 having a flat support surface 24 supporting a series of the objects 14 to be wrapped and sealed in packaging material. The objects are placed on the surface 24 from a source not shown. The in-feed conveyor support surface 24 has a longitudinal center opening 26 through which project a plurality of longitudinally spaced pushing fingers 28 of the in-feed conveying system. The plurality of fingers 28 extend up through the center opening 26 of the feed conveyor support surface 24 and are driven longitudinally along the center opening 26 by a continuous belt 32 (shown only schematically in the drawing figures) that continuously drives the spaced plurality of fingers 28 through the center opening 26 in a left to right direction as viewed in the drawing figures. Each of the individual fingers 28 of the plurality pushes one of the objects 14 before it over the support surface 24 of the feed conveyor 22 to a folding station 32 of the packaging system 12 where the objects 14 are wrapped in packaging material 16.

At the folding station 32, a continuous length of the packaging material or film 16 is unrolled from a roll supply 34 of the film and directed through a plurality of tensioning rollers 36 to a folding tube 38. The continuous, longitudinal length of packaging material or film 16 enters the forward end of the folding tube 38 in the same direction that the succession of objects 14 are inserted into the folding tube 38 by the conveyor fingers 28. In the folding tube 38, the continuous length of packaging material 16 is folded over the top and around the opposite lateral sides of each of the succession of objects 14 and the opposite lateral edges of the material 16 are folded underneath each of the objects 14 and meet along a seam 40 that extends longitudinally beneath the center of each of the objects 14. The seam 40 is formed by folding marginal portions of the packaging material 16 along the opposite lateral edges of the material underneath each of the objects 14. The marginal portions or flaps of the packaging material 16 are folded flat against each other beneath the center of each of the objects 14 so that the terminal lateral edges of the packaging material 16 are positioned side by side and extend longitudinally beneath the center of each of the objects 14. After each of the succession of objects 14 have been wrapped in the packaging material 16 at the folding station 32, the wrapped objects then proceed from left to right as viewed in the drawing figure along the packaging system 12 to the air extraction station 42.

At the air extraction station 42 the packaging material 16 is drawn tight around each of the wrapped objects 14 by withdrawing air from the interior volume of the packaging material 16 surrounding the objects. At the air extraction station 42 the succession of wrapped objects 14 are transferred from the feed conveyor support surface 24 to a deck plate support surface 44. The deck plate support surface 44 also has a narrow longitudinal slot 46 extending along its length. The unsealed longitudinal seam in the packaging material 16 folded on the underside of each of the objects 14 is directed into the longitudinal slot 46 of the deck plate as the succession of wrapped objects 14 are transferred along the packaging system 12. Beneath the deck plate 44 is a first pair of friction rollers 48 that roll against each other and grip a portion of the packaging material seam 40 that extends through the deck plate slot 46 beneath the deck plate. Each of the rollers are driven by a conventional motive source (not shown). The rolling contact of the pair of friction rollers 48 over the opposite sides of the packaging material seam 40 moves the seam from left to right through the slot of the deck plate 44. As the longitudinal seam 40 of packaging material 16 is gripped between the pair of friction rollers 48 and moved longitudinally through the deck plate slot 46, the succession of objects 14 wrapped in the packaging material are moved longitudinally over the top surface of the deck plate 44 from left to right as viewed in the drawing figures.

Draped over the deck plate 44 and the succession of wrapped objects 14 moved over the top surface of the deck plate is a pressure belt 52. The pressure belt lays over the succession of wrapped objects 14 as they are moved longitudinally beneath the belt and presses the packaging material surrounding the objects flat against the top surface of the deck plate 44. This initially removes some of the excess air in the packaging material surrounding the objects 14 and holds the packaging material flat against the top and bottom surfaces of the succession of objects 14 as they are moved beneath the belt 52. The belt is basically comprised of a plurality of generally rectangular panels 54 having flat, smooth bottom surfaces that enable the packaging material 16 wrapped around the succession of objects 14 to easily pass in sliding engagement beneath the belt. Each of the panels 54 are interconnected by hinge assemblies 56 that give the belt 52 flexibility to move over the packaging material 16 and objects 14 as they are conveyed beneath the belt. The forward end or left hand end of the belt as viewed in the drawing figures is pivotally connected to a pivot post 58 that is connected to a stationary support 62 mounted on the deck plate 44. The support 62 positions the pivot post 58 extending transversely over the center of the deck plate slot 46. Besides pressing the packaging material 16 against the opposite top and bottom surfaces of the succession of objects 14 as they are passed beneath the belt 52, the belt also serves to hold each of the successive objects 14 and the packaging material 16 wrapped around the objects flat against the top surface of the deck plate 44 as the seam of packaging material 40 extending through the deck plate slot 46 is passed through the air extraction apparatus 10 of the present invention. In this manner the belt 52 assists the apparatus 10 in withdrawing air from the packaging in a manner yet to be described. As the succession of objects 14 wrapped in the packaging material 16 exit the air extraction station 42 they enter the longitudinal seam sealing station 64.

The seam sealing station 64 is basically comprised of a pair of rollers 66 that, like the pair of friction rollers 48, drive against each other while gripping and moving the folded seam 40 of the packaging material 16 longitudinally between the pair of rollers 66. Like the friction rollers 48, the sealing rollers 66 also cause the succession of wrapped objects 14 to be moved longitudinally over the surface of the deck plate 44 as the rollers 66 bear in rolling contact with the seam 40 of packaging material extending through the deck plate slot 46. As the sealing rollers 66 bear against each other, they move the packaging material seam 40 between the pair of rollers and longitudinally along the deck plate slot 46 on the underside of the deck plate. Both rollers 66 of the pair of sealing rollers are heated so that as the seam 44 of packaging materials 16 exits the air extraction station 42 and passes between the sealing rollers 66, the heat of the rollers seals the overlapping marginal edges of the packaging material 16 at the seam 40. At this point in the packaging system 12, the longitudinal length of packaging material 16 is wrapped tightly around the opposite lateral sides of the succession of objects 14 and is sealed as a flat tube of material in close engagement with the objects 14 wrapped therein. The succession of objects 14 now wrapped and sealed in a tube of packaging material 16 exit the sealing station 64 and enter a transverse or a lateral sealing and cutting station 72. As the tube of packaging material 16 wrapped and longitudinally sealed around the succession of objects 14 exits the sealing station 64, the sealed longitudinal seam 40 beneath the succession of objects 14 is passed through another pair of friction rollers 74 that bear against the opposite lateral sides of the sealed seam 40 and move the seam and the succession of wrapped objects 14 toward the lateral sealing and cutting station 72.

The lateral sealing and cutting station 72 is generally comprised of a pair of heat sealing and cutting devices 76, with each device being positioned above and below the terminal end or right hand end of the deck plate 44 as viewed in the drawing figures. The lateral sealing and cutting devices 76 are conventional and reciprocate toward and away from each other in a timed sequence with the passage of the succession of wrapped objects 14 conveyed over the packaging system 12. The lateral heat sealing and cutting devices 76 are timed with the passage of the succession of wrapped objects 14 so that they come together against the wrapped packaging material 16 between adjacent objects 14 in the succession to heat seal the packaging material 16 between adjacent objects 14 while simultaneously cutting a lateral cut across the heat sealed portion of the packaging material between the objects. This final heat sealing and cutting operation completes the packaging of the continuous succession of objects 14 by the packaging system 12.

The packaging system 12 described to this point is conventional and has not been described in great detail. The air extraction apparatus 10 of the present invention is specifically designed to be incorporated in a packaging system assembly such as that described, or retrofit to an existing packaging system assembly. The apparatus of the invention 10 provides an improved method of extracting air from the packaging material and thereby increases the efficiency of the packaging system in producing sealed packaging around a succession of objects where the increase in volume or size of the objects by wrapping them in the packaging material is kept to a minimum.

As shown in the drawing figures and as described earlier, the air extraction apparatus 10 of the present invention is assembled to the underside of the packaging system deck plate 44 in an area beneath the pressure belt 52. In assembling the improved air extraction apparatus 10 to the packaging system 12, the apparatus is connected through a fluid conducting conduit 82 to a source of vacuum pressure 84. A manual control valve 86 and a pressure site gauge 88 are provided in the conduit 82 to control the level of vacuum pressure supplied to the apparatus 10 at a desired level.

Figure 7:
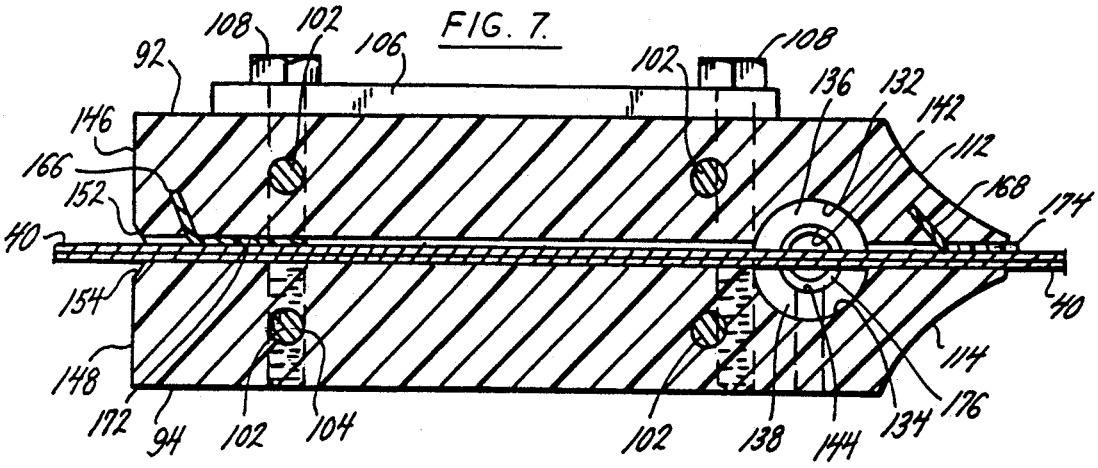
FIG. 7 is a plan view, in section, taken along the line 7—7 of FIG. 4.
Figure 8:
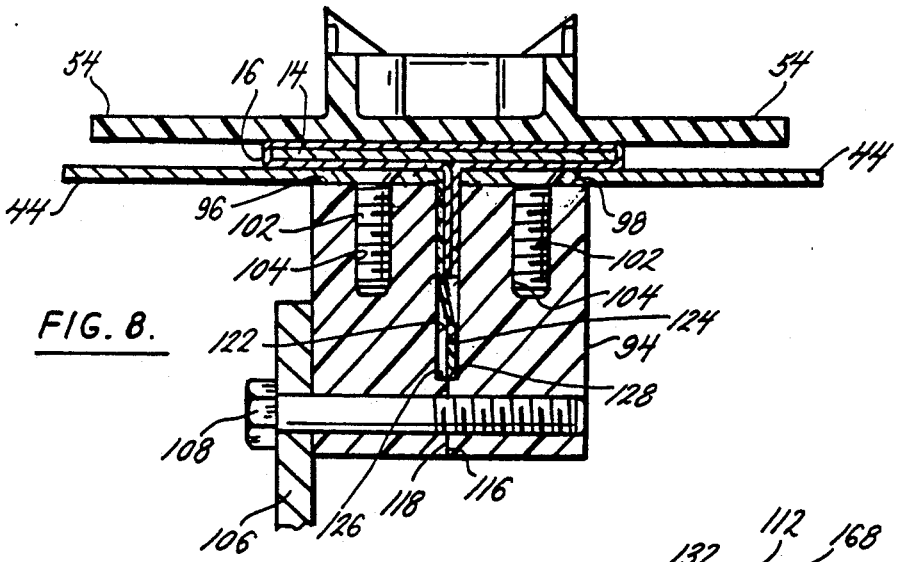
FIG. 8 is an elevation view, in section, taken along the line 8—8 of FIG. 4; and, FIG. 9 is a segmented perspective view of one-half of the apparatus of the invention.
Figure 9:
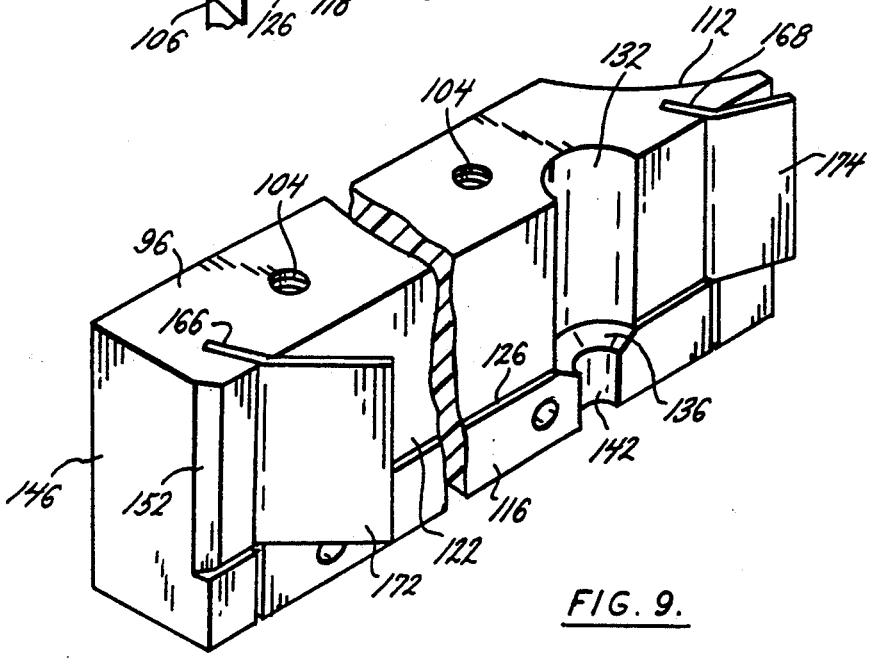

As is best seen in FIGS. 7-9, the air extraction apparatus 10 of the present invention is basically configured as a block comprised of first 92 and second 94 half members that are, for the most part, mirror images of each other. The top surfaces 96, 98 of each of the half members 92, 94 are substantially flat to enable the apparatus 10 to be assembled to the flat underside of the deck plate support surface 44 of the air extraction station 42. The assembled block half members 92, 94 may be secured to the deck plate 44 by bolts 102 extending through the deck plate and into threaded bore holes 104 formed in the half members or by other equivalent fastening methods. For example, the assembled half members of the apparatus 10 may be secured relative to the underside of the deck plate 44 by a separate bracket or flange 106 of the packaging system 12 also bolted to the half members by a pair of bolts 108 extending laterally through the bracket 106 and into concentric threaded bore holes extending through both the half members 92, 94. The exterior surfaces of the two half members 92, 94 are generally planar except for the exterior surfaces at the rearward ends 112, 114 of the two half members. The two rearward end surfaces 112, 114 are positioned on opposite sides of the packaging material seam 40 as it exits the air extraction apparatus 10 in a manner to be explained, and each of the rearward end surfaces 112, 114 have a curvature that is complementary to the curvature of the two heat sealing rollers 66 of the packaging system. The curvature of the rearward end surfaces 112, 114 enables the air extraction apparatus 10 to be positioned in close proximity to the pair of heat sealing rollers 66 so that the overlapping marginal flaps of packaging material that make up the seam 40 are heat sealed by the rollers 66 almost immediately after they exit the air extraction apparatus 10. This enables the packaging material 16 wrapped around the succession of objects 14 to be quickly sealed along the longitudinal seam 40 almost immediately after the air is extracted from the interior of the packaging material by the air extraction apparatus of the invention 10.

Mutually opposed faces 116, 118 of the first and second half members 92, 94 have recessed side surfaces 122, 124 that extend longitudinally across the opposed faces of the half members and downward from the top surfaces 96, 98 to bottom walls 126, 128 of the recesses. A semicircular half vacuum chamber 132, 134 is formed in each of the recessed side surfaces 122, 124 of the half members 92, 94. The semicircular half chambers 132, 134 have tapered bottom surfaces 136, 138 with half conduits 142, 144 formed at the centers of the bottom surfaces 136, 138. The half conduits 142, 144 extend from the interior volumes of the semicircular half chambers 132, 134 out the bottom exterior surfaces of the two half members 92, 94.

The forward end surfaces 146, 148 of each of the half members 92, 94 have champhered surfaces 152, 154 formed therein leading to the recessed side surfaces 122, 124 of the half members. The pair of champhered surfaces 152, 154 direct the overlapping flaps of the packaging material seam 40 in between the opposed recessed side surfaces 122, 124 of the two half members when the half members are assembled together to form the air extraction apparatus 10.

The construction of the air extraction apparatus first half member 92 differs from that of the second half member 94 in that a pair of sealing members are secured to the recessed side surface 122 of the first half member. As is best seen in FIG. 9, the first half member 92 has a pair of angled grooves 166, 168 formed into the half member from the recessed side surface 122. As seen in the drawing figures, the grooves 166, 168 are angled slightly relative to the side surface 122 and extend the entire vertical length of the side surface between the top surface 96 of the half member and the bottom wall 126 of the half member side surface 122. Inserted into the pair of grooves 166, 168 and secured therein by adhesives or other equivalent means are a pair of flexible strips 172, 174. As shown in the drawing figures, the strips 172, 174 have a general rectangular configuration and are preferably formed of a plastic material that gives the strips a flexibility that enables them to resiliently deform and extend in a longitudinal downstream direction along the recessed side surface 122 of the first half member 92.

When the two air extraction device half members 92, 94 are assembled together as shown in FIGS. 5-8, the two recessed side surfaces 122, 124 and the two bottom surfaces 126, 128 together form a slot extending longitudinally through the air extraction device 10 between the forward surfaces 146, 148 of the device and the rearward surfaces 112, 114 of the device. As seen in FIG. 7, the two champhered surfaces 152, 154 at the forward end surfaces 146, 148 of the air extraction device direct the overlapping flaps of packaging material that form the seam 40 into the slot formed in the device by the pair of recessed surfaces 122, 124. As the flaps of overlapping packaging material forming the seam 40 are directed through the slot formed in the air extraction device 10, the pair of flexible strips 172, 174 resiliently bear against one side of the overlapping flaps forming the seam 40 and press the flaps against the opposite recessed side surface 124 of the device, thereby providing a seal at these two areas of the overlapping flaps of the seam 40, and also providing a seal that inhibits the entry of air exterior to the device 10 into the slot formed by the two recessed surfaces 122, 124.

With the two half members 92, 94 assembled together to form the air extraction device 10, the semicircular half chambers 132, 134 together form a cylindrical air evacuation chamber. In a like manner, the pair of tapered bottom surfaces 136, 138 and the pair of half conduits 142, 144 together define a cylindrical air extraction conduit that communicates through a tapered portion of the air extraction chamber with the interior volume of the air extraction chamber formed by the two semicircular half chambers 132, 134. As seen in FIG. 7, the air extraction chamber formed by the two half chambers 132, 134 is positioned in the air extraction device 10 between the two sealing strips 172, 174. In this manner, the air extraction chamber formed by the two half chambers 132, 134 is sealed from the environment outside the chamber by the two sealing flexible strips 172, 174 positioned in the slot formed by the recessed side surfaces 122, 124 and by the two bottom surfaces 126, 128 of the slot. This enables the air extraction device 10 of the present invention to concentrate a vacuum pressure supplied through the half conduits 142, 144 to the interior of the half chambers 132, 134 by an exterior vacuum source along a portion of the packaging material seam 40 sealed between the two flexible strips 172, 174.

As shown in FIGS. 5 and 6, an outlet fitting 176 is secured in the conduit formed by the half conduits 142, 144 of the two half members 92, 94 and communicates with the conduit 82 leading to the external source of vacuum pressure 84. In this manner, a vacuum pressure is supplied to the interior of the vacuum chamber formed by the two chamber half members 132, 134. The vacuum pressure supplied to the vacuum chamber of the air extraction device draws air from the interior of the packaging material 16 wrapped around the succession of objects 14 as portions of the packaging material seam 40 are conveyed through the slot in the apparatus 10 and between the pair of sealing strips 172, 174. After air has been extracted from the interior of the packaging material 16 through the flaps forming the seam 40, the seam 40 exits the apparatus 10 and almost immediately is received between the pair of heated rollers 66 where the seam is sealed closed. In this manner, the air extraction apparatus 10 of the present invention efficiently extracts air from the interior of the packaging material 16 surrounding the succession of objects 14 and then enables the seam 40 of the packaging material to be almost immediately sealed by the pair of heated sealing rollers 66. The construction of the air extraction apparatus 10 of the present invention described above enables the apparatus to be included as a component part of a packaging system to be assembled, and also enables the apparatus 10 to be retrofit to an existing packaging system.

While the present invention has been described by reference to a specific embodiment, it should be understood that modifications and variations of the invention may be constructed without departing from the scope of the invention defined in the following claims.

What is claimed is:

1. An improved air extraction apparatus for drawing air from an interior volume of a longitudinally extending, continuously moving tube of packaging material with a continuous succession of objects enclosed therein, the tube having an unsealed longitudinally extending seal from which project two unsealed overlapping flaps, the apparatus comprising:

a pair of conveyor top surfaces for engaging and supporting the continuously moving tube, the pair of top surfaces being substantially coplanar and laterally spaced apart forming a longitudinally extending slot between the top surfaces;

a pair of conveyor side surfaces each joined to and depending downward from one of the pair of top surfaces, the pair of side surfaces being substantially parallel and laterally spaced apart so that they mutually oppose each other and form a longitudinally extending slot between the side surfaces that is an extension of the slot between the top surfaces, the side surfaces directing the overlapping flaps of the packaging material longitudinally through the slot between the side surfaces as the packaging material is continuously moved over the conveyor top surfaces;

means for subjecting the slot between the side surfaces to a vacuum pressure for drawing air out of the interior volume of the packaging material and through portions of the overlapping flaps directed through the slot as the packaging material is continuously moved over the conveyor top surfaces;

means provided in the slot between the side surfaces at longitudinally spaced positions on opposite sides of the means for subjecting the slot to vacuum pressure for sealing across the slot between the side surfaces;

the means for sealing across the slot between the side surfaces also engages against the overlapping flaps of packaging material at opposite longitudinal ends of the portions of the overlapping flaps directed through the slot; and the means for sealing across the slot engages against the overlapping flaps of packaging material for causing the overlapping flaps to press against each other.

2. The apparatus of claim 1, wherein:

the means for sealing across the slot between the side surfaces includes at least one pair of flexible strips, each strip of the pair being fixed to one of the pair of side surfaces and extending across the slot and engaging against the other of the pair of side surfaces thereby forming a seal across the slot, the pair of strips being fixed at longitudinally spaced positions in the slot on opposite sides of the means for subjecting the slot to vacuum pressure.

3. The apparatus of claim 2, wherein:

the pair of strips engage against the overlapping flaps of packaging material at opposite longitudinal ends of the portions of the overlapping flaps directed through the slot and on opposite sides of the means for subjecting the slot to vacuum pressure, causing the overlapping flaps to engage against each other on opposite sides of the means for subjecting the slot to vacuum pressure.

4. The apparatus of claim 1, wherein:

the means for subjecting the slot to vacuum pressure includes a vacuum pump connected in fluid communication with the slot between the side surfaces.

5. The apparatus of claim 4, wherein:

a pair of recessed cavities are formed in the pair of side surfaces with each cavity of the pair being formed in one of the side surfaces in mutually opposed relation, the pair of cavities forming a vacuum chamber in the slot between the side surfaces and the vacuum chamber being connected in fluid communication with the vacuum pump.

6. The apparatus of claim 2, wherein:

each strip has opposite lateral edges and opposite top and bottom edges with one lateral edge secured to one side surface and the other lateral edge engaging against the other side surface.

7. The apparatus of claim 6, wherein:

a bottom wall extends laterally between the side surfaces and longitudinally below the slot between the side surfaces, and the pair of strips each extend from adjacent the bottom wall to adjacent the conveyor top surface between the bottom and top edges of each strip.

8. An improved air extraction apparatus that continuously packages a series of objects in a continuous length of packaging material folded around the objects in a manner that produces a continuous seam with two projecting, overlapping flaps, the apparatus including a pair of driven rollers with opposed gripping surfaces that move the packaging material over the apparatus and seal the flaps together when gripping the flaps therebetween; the apparatus comprising:

a block member having a conveyor surface thereon for supporting the packaging material as it moves over the apparatus, the block member having a longitudinal slot formed therein, the slot having a pair of opposed side surfaces extending downward from the conveyor surface to a bottom wall of the slot that extends laterally between the side surfaces, the block member and the slot being positioned relative to the driven rollers so that packaging material moved over the apparatus by the rollers moves over the conveyor surface and the overlapping flaps of the packaging material move longitudinally through the slot prior to being gripped between the driven rollers;

means producing a vacuum pressure in the slot for drawing air out of the slot and out of the packaging material through the overlapping flaps as the overlapping flaps move longitudinally through the slot; and, means within the slot for sealing laterally across the slot and for pressing the overlapping flaps against each other as the flaps move longitudinally through the slot.

9. The apparatus of claim 8, wherein:

the means for sealing laterally across the slot and for pressing the overlapping flaps against each other is positioned in the slot at longitudinally spaced positions on opposite sides of the means producing a vacuum pressure in the slot.

10. The apparatus of claim 8, wherein:

the block member is configured to be retrofit to an existing air extraction apparatus with the slot in the block member being aligned with a slot of the apparatus through which the overlapping flaps of packaging material are directed.

11. The apparatus of claim 9, wherein:

the means for sealing laterally across the slot includes at least a pair of flexible strips, each strip being secured to one side surface of the slot at opposite longitudinal sides of the means producing a vacuum pressure in the slot and extending laterally across the slot and engaging against the other side surface of the slot.

12. The apparatus of claim 11, wherein:

each strip has opposite lateral edges and opposite top and bottom edges, one of the lateral edges of each strip is secured to one of the side surfaces and the other lateral edge engages against the other side surface, the bottom edge of each strip is positioned adjacent the bottom wall of the slot and the top edge of each strip is positioned adjacent the conveyor surface of the block member.

13. The apparatus of claim 12, wherein:

the other lateral edge of each of the strips engages against and presses the overlapping flaps of packaging material against each other as the overlapping flaps move longitudinally through the slot.

14. The apparatus of claim 8, wherein:

the means for producing a vacuum pressure in the slot includes a vacuum chamber formed in the slot, the chamber having a greater lateral width than a lateral width of the slot, and including a vacuum pump connected in fluid communication with the chamber for drawing air out of the slot and the chamber.

15. The apparatus of claim 11, wherein:

the block member is assembled from half sections that separate along a partition which intersects the slot and is generally parallel to the slot side surfaces, whereby disassembly of the block member into the half sections provides access to the flexible strips.

16. The apparatus of claim 8, wherein:

the opposed side surfaces of the slot extend longitudinally through the block member and terminate adjacent the opposed gripping surfaces of the driven rollers, and the block member has an exterior configuration that extends longitudinally between portions of the driven rollers to position the slot in close proximity to the driven rollers' gripping surfaces.

17. The apparatus of claim 16, wherein:

the exterior configuration of the block member includes a pair of concave surfaces that partially circumscribe the driven rollers.

* * * * *